US005365852A

United States Patent [19]

Bender et al.

[11] Patent Number: 5,365,852

[45] **Date of Patent: * Nov. 22, 1994**

[54] METHOD AND APPARATUS FOR PROVIDING AN EXPLOSIVELY FORMED PENETRATOR HAVING FINS

[75] Inventors: David E. Bender, Mission Viejo; Joseph Carleone, Yorba Linda, both of Calif.

[73] Assignee: Aerojet-General Corporation, Rancho Cordova, Calif.

[ * ] Notice: The portion of the term of this patent subsequent to Mar. 22, 2007 has been disclaimed.

[21] Appl. No.: 294,448

[22] Filed: Jan. 9, 1989

[51] Int. Cl.[5] ..... F42B 12/04; F42B 1/02

[52] U.S. Cl. ..... 102/476; 102/501; 86/20.1; 86/20.14; 244/3.24

[58] Field of Search ..... 102/305–310, 102/475, 476, 501; 86/20.1, 20.14; 244/3.24

[56] References Cited

U.S. PATENT DOCUMENTS

| | | | |
|---|---|---|---|
| 4,590,861 | 5/1986 | Bugiel . | |
| 4,622,901 | 11/1986 | Witt et al. | 102/476 |
| 4,714,019 | 12/1987 | Lips et al. . | |
| 4,776,272 | 10/1988 | Lindstadt et al. | 102/476 |
| 4,875,414 | 10/1989 | Stadler et al. | 102/307 |
| 4,922,825 | 5/1990 | Aubry et al. | 102/476 |
| 4,982,669 | 1/1991 | Weimann | 102/476 |
| 5,033,387 | 7/1991 | Lips | 102/476 |

FOREIGN PATENT DOCUMENTS

| | | | |
|---|---|---|---|
| 3830527 | 3/1990 | Germany | 102/476 |

*Primary Examiner*—Harold J. Tudor
*Attorney, Agent, or Firm*—Leonard Tachner

[57] ABSTRACT

An improved explosively formed penetrator and a method of manufacturing same for forming an elongated rod-like penetrator having aerodynamically stabilizing fins, but without requiring any exotic production processes for shaping or modifying the characteristics of a conventional liner normally used in such penetrators. The present invention comprises a specially shaped thin foil which is placed between the liner and the explosive charge and which provides a selected plurality of radial legs which, in a preferred embodiment, are symmetrically placed around a center portion axially aligned with the center of the liner. The combined axial thickness of the liner and the radial legs of the thin foil lag behind the thinner portions of the liner alone, thereby causing the explosively formed penetrator to form unevenly, hence forming fins.

5 Claims, 1 Drawing Sheet

METHOD AND APPARATUS FOR PROVIDING AN EXPLOSIVELY FORMED PENETRATOR HAVING FINS

BACKGROUND OF THE INVENTION

1. Field of the Invention

The present invention relates generally to explosively formed penetrator warheads of the type used to attack an armor protected target and, more specifically, to an improved method and apparatus for assuring the explosive formation of a penetrator having aerodynamically stabilizing fins to form a more effective penetrator.

2. Prior Art

The explosively formed penetrator (EFP) warhead also known as explosively formed projectile, self forging fragment, Misznay-Schardin Charge, and the P-charge employs the method of explosively forming a metal liner into a single compact fragment and projecting it at armored targets at extremely high velocity. Upon impacting the target in excess of 2000 m/s an EFP deposits an enormous amount of kinetic energy at extremely high rates.

It is well known in the armor piercing projectile art to provide a deformable metallic insert (often called a warhead liner) for a hollow charge armor piercing projectile wherein the liner is collapsed by the detonation of the charge into an elongated dart-shaped projectile capable of penetrating the shell of an armored vehicle or the like. Inserts of this type have been disclosed for example in U.S. Pat. Nos. 3,217,647 and 3,732,816.

The earliest published demonstration of such a device was by R. W. Wood in 1936. During the early to mid-seventies, EFP technology escalated significantly, primarily because of two simultaneous developments: (1) the success of computer simulation techniques to model the EFP device, and (2) several system concepts sponsored by both the Army and Air Force that used EFP technology. This work demonstrated that virtually all practical axisymmetric shapes can be explosively formed by varying the contour and thickness profile of the metal liner in the proper way. In fact, many shapes, such as compact spheroids, long rods, hollow cups, and rods with a conical flare for aerodynamic stability have been demonstrated.

It is also well known in the art to provide such insert or liners with exotic shapes or material variations which are designed to produce wing stubs or rear end flares upon full deformation of the penetrator, for aerodynamically stabilizing the projectile in flight to increase its penetration performance.

The addition of forming fins as a means of providing aerodynamic stability to an EFP has several advantages over the conventional drag cone or flared tail. By replacing the drag cone with fins aerodynamic drag is reduced increasing terminal velocity at current state-of-the-art standoffs or increasing the current standoffs with no loss in terminal velocity. Also by forming fins additional liner material is concentrated towards the EFP's axis of symmetry, hence, increasing its penetration capability over that of an EFP with a hollow flare. In addition it is known that every EFP has some degree of nonsymmetry in the flare due to random buckling during formation. With fins the EFP is buckled in a controlled manner hence, decreasing random buckling and increasing formation repeatability. Finally by inducing spin into the EFP by canting the fins aimpoint accuracy is increased over that of the conventional flared EFP.

In U.S. Pat. No. 4,590,861 the disclosed insert is provided with a non-constant or varying material thickness extending in the centripetal direction in which the insert incorporates peripherally mutually offset centripetally extending zones with a material thickness which is constant in the centripetal direction and which alternate with centripetally extending zones having a non-constant varying material thickness. Similarly, in U.S. Pat. No. 4,714,019, the insert comprises a flat disk having differing material properties in the inner and outer regions which result in varying dynamic material behavior during explosion deformation. In the disclosed embodiment, the outer regions of the flat disk have a greater material hardness than the central regions of the disk.

Unfortunately, each such prior art liner while being advantageous from the standpoint of producing trajectory stabilizing rear end formations during the explosive forming process, presents significant disadvantages from the standpoint of production and cost. Such exotic variations in material shape or hardness or other such parameters require special time consuming and costly production processes as compared to a substantially uniform thickness and simply shaped liner. There has therefore been a long felt need for an explosively formed penetrator liner apparatus and method of production which provides the aforementioned advantages of rear end aerodynamically stabilizing fins or the like, but without the production and cost disadvantages of the prior art.

SUMMARY OF THE INVENTION

The present invention solves the aforementioned long felt need by providing an explosively formed penetrator and method of production thereof which obviate the prior art requirement for an exotic shaped liner or a liner having exotic material variations. The present invention still provides, after explosive formation, a penetrator having a selected plurality of rear fins which stabilize the penetrator during its aerodynamic flight to increase the performance thereof. More specifically, in the present invention, the liner is of an axially symmetric thickness and simple configuration, the shape thereof being selected merely to assure the formation of a penetrator shape upon explosive deformation of the liner without any regard for providing any special variations in shape or material thickness to produce the aforementioned fins. Instead, in the present invention, the aerodynamically stabilizing fins of the liner are achieved by placing a properly shaped thin, constant thickness foil between the liner and the explosive charge so that there are periodic variations in the axial thickness of the combined liner and thin foil. These thickness variations cause the tail of explosively formed penetrator to form unevenly with the thicker part of the axial thickness lagging behind the thinner portions thereof in both the axial and radial directions, hence, forming fins. The thin foil, which may be both significantly thinner than the liner and thus, more easily cut, or stamped into the desired shape, may be provided with any number of selected radial portions extending from the center of the liner in contiguous engagement with the liner to form a corresponding number of fins after full deformation. The method of the present invention comprises the step of forming the thin foil into the desired shape and placing it between the liner and the charge during assembly, thereby obviating the prior art requirement for introducing exotic three-dimensional shapes and material variations into the liner itself.

OBJECTS OF THE INVENTION

It is therefore a principal object of the present invention to provide an improved explosively formed penetrator and method of manufacture thereof which results in a explosively formed penetrator having aerodynamically stabilizing fins while obviating the prior art requirement of utilizing exotic liner shapes and material variations which otherwise result in substantially increased production time and cost.

It is an additional object of the present invention to provide an improved explosively formed penetrator having a plurality of aerodynamically stabilizing fins after explosive deformation while allowing the use of a liner which is of a conventional shape and thickness by utilizing a thin foil installed between the liner and the charge.

It is still an additional object of the present invention to provide an improved explosively formed penetrator which, while having a liner of conventional and easy to produce configuration, results in a penetrator having aerodynamically stabilizing fins because of the insertion between the liner and the charge of an easily shaped thin foil having a plurality of radially extending arms in contiguous engagement with the liner, each such arm producing a corresponding fin in the deformed penetrator.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
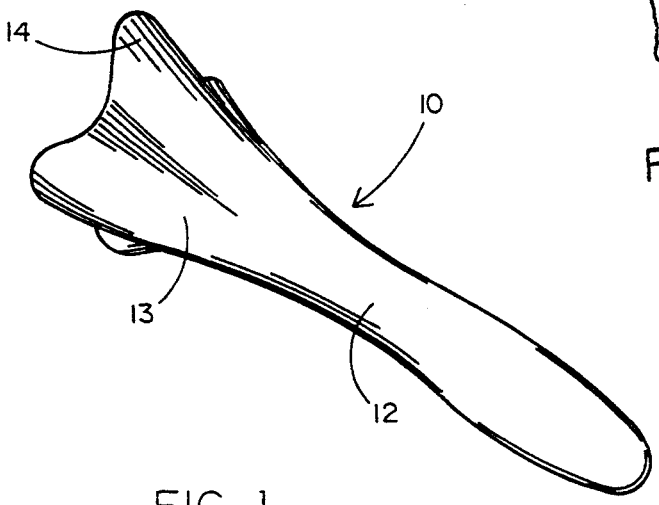
FIG. 1 is an isometric view of the penetrator of the present invention showing its fully formed configuration and the aerodynamically stabilizing fins thereof.

It will be seen in FIG. 1 of the accompanying drawings that the explosively formed penetrator 10 of the present invention comprises a long rod 12 having a flared rear end 13 which terminates in a plurality of aerodynamic fins 14. Such aerodynamic stabilizing fins provide several advantages over the conventional drag cone or flared tail. By replacing the drag cone with fins, aerodynamic drag is reduced increasing terminal velocity at current state of the art stand-off distances or by increasing current stand-off distances with no loss in terminal velocity. Also by forming fins, additional liner material is concentrated toward the axis of symmetry of the explosively formed penetrator thereby increasing its penetration capability over that of penetrator with a hollow flare. In addition, it is known that every explosively formed penetrator has some degree of non-symmetry in the flare due to random buckling during formation. With fins of the type disclosed in FIG. 1 herein, the explosively formed penetrator is buckled in a controlled manner, thereby decreasing random buckling and increasing formation repeatability. Furthermore, by inducing spin into the explosively formed penetrator by canting the fins, aim point accuracy is increased over that of the conventional flared, explosively formed penetrator.

Figure 2:
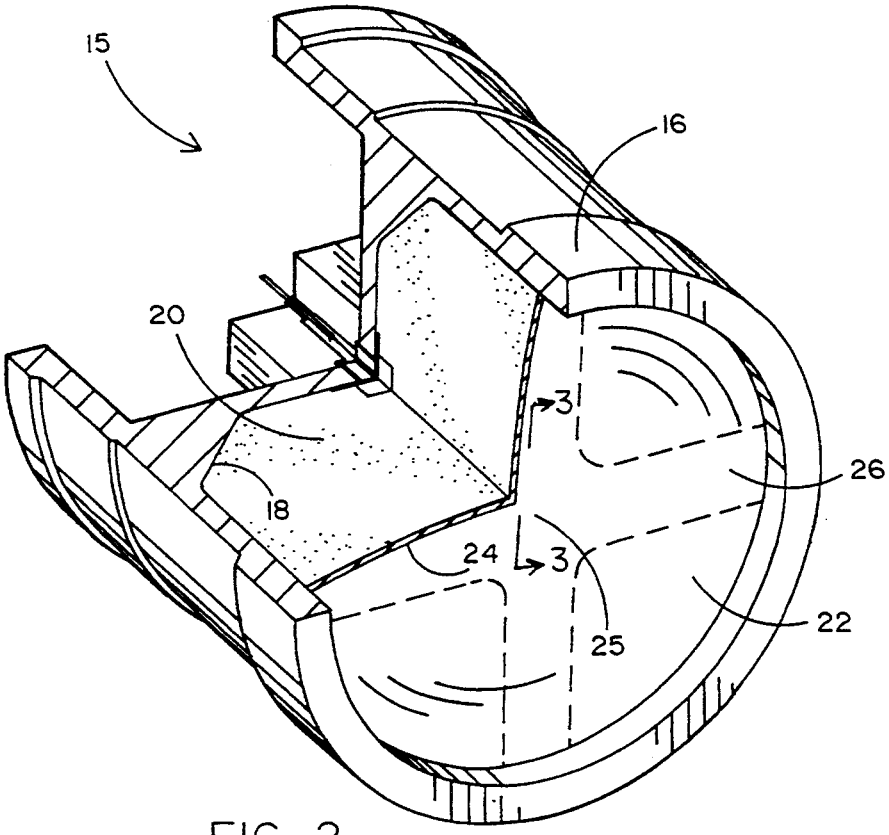
FIG. 2 is an isometric, partially broken away, view of the penetrator of the present invention shown in its initial configuration prior to explosive formation of the liner.

The manner in which the fins 14 of the penetrator 10 of the present invention can be induced is shown in FIG. 2 which illustrates the method and apparatus of the present invention. More specifically, FIG. 2 illustrates the unexploded configuration 15 of the invention which comprises a casing 16 preferably made of steel and forming a chamber 18 therein which is packed with an explosive charge 20. The rear end of the casing 16 is enclosed by a liner 22 which, because of the novel improvement of the present invention, may be of a conventional configuration which includes conventional axially symmetric shape and material characteristics.

Figure 3:
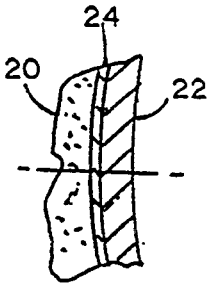
FIG. 3 is a cross-sectional view taken along lines 3—3 in FIG. 2 showing the relationship between the charge, liner and foil of the invention prior to deformation.

The fin forming characteristics of the present invention are induced by providing a thin constant thickness foil 24 which is positioned between the liner 22 and the explosive charge 20 as seen best in FIG. 3. In a preferable configuration of the present invention, the thin foil 24 is provided with a plurality of radial legs 26 extending from a central region 25 which is preferably symmetrically placed relative to the center of the liner 22. The periodic radial legs of the liner provide variations of the axial thickness of the combined liner and foil which cause the tail of the explosively formed penetrator 10 to form unevenly. The thicker part of liner/foil combination lags behind the thinner portion where the liner 22 has no corresponding contiguous foil portion, in both the axial and radial directions, thereby forming fins.

The axial thickness of the foil 24 may be significantly smaller than the axial thickness of the liner 22. By way of example, the axial thickness of the foil 24 may be less than 25 percent of the axial thickness of the liner. As a result, foil 24 is far more easily shaped to the desired configuration by the simple and relatively low cost processes of cutting or stamping operations. This obviates what would be a much more complex and costly process to periodically vary the thickness of the liner itself to achieve the desired result. Thus, the present invention achieves the formation of fins in an explosively formed penetrator while obviating the prior art disadvantages of high cost and time consuming production of an exotically shaped or otherwise treated liner to achieve the same result.

The method of the present invention is that of first preparing a thin foil in the manner shown in FIG. 2, namely, by cutting, stamping or otherwise forming it to provide a desired plurality of radial legs extending from an axially symmetric center portion and then placing the thin foil between the liner and the explosive charge adjacent the charge chamber 18 within the casing 16.

It will now be understood that what has been disclosed herein comprises an improved explosively formed penetrator and a method of manufacturing same for forming an elongated rod-like penetrator having aerodynamically stabilizing fins., but without requiring any exotic production processes for shaping or modifying the characteristics of a conventional liner normally used in such penetrators. More specifically, the present invention comprises a specially shaped thin foil which is placed between the liner and the explosive charge and which provides a selected plurality of radial legs which, in a preferred embodiment, are symmetrically placed around a center portion axially aligned with the center of the liner. The combined axial thickness of the liner and the radial legs of the thin foil lag behind the thinner portions of the liner alone thereby causing the explosively formed penetrator to form unevenly, hence forming fins.

Those having skill in the art to which the present invention pertains, will now as a result of the applicant's teaching herein, perceive various modifications and additions which may be made to the invention. By way of example, the specific thickness and shape of the liner as well as the number of radial legs, the shape of those legs and the axis of symmetry of those legs, may be altered to change the fin forming characteristic of the liner and foil combination to produce fins having a configuration other than those shown in the accompanying figures. Accordingly, all such modifications and additions are deemed to be within the scope of the invention which is to be limited only by the claims appended hereto.

We claim:

1. An improved explosively formed penetrator assembly having a casing, a chamber in the casing, an explosive charge in the chamber and a deformable liner adjacent the explosive charge, the liner being deformed into an elongated penetrator upon explosion of the charge; the improvement comprising:

a foil between said explosive charge and said liner, said foil having a plurality of legs extending radially from a central portion for altering the explosive deformation of said liner to induce rear end fins in said elongated penetrator.

2. The improvement recited in claim 1 wherein the thickness of said foil is less than about 25% of the thickness of said liner.

3. The improvement recited in claim 1 wherein said foil is of substantially uniform thickness.

4. A method for fabricating an explosively formed penetrator assembly having a casing, a chamber in the casing, an explosive charge in the chamber and a deformable liner adjacent the explosive charge, the liner being deformed into an elongated penetrator upon explosion of the charge; the method comprising the steps of:

a) forming a foil having a plurality of legs extending radially from a central portion; and b) placing said foil between said liner and said charge.

5. The method recited in claim 4 wherein step a) comprises the step of forming said radially extending legs to be of equal dimensions and positioned symmetrically about said central portion.

* * * * *